US005329649A

United States Patent [19]

Turek

[11] Patent Number: 5,329,649

[45] Date of Patent: Jul. 19, 1994

[54] SAFETY BATHING SHOWER/TUB APPARATUS

[76] Inventor: Robert L. Turek, 1919 Grand Ave., Ste. 1-K, San Diego, Calif. 92109

[21] Appl. No.: 64,793

[22] Filed: May 19, 1993

Related U.S. Application Data

[63] Continuation of Ser. No. 617,145, Nov. 23, 1990, abandoned.

[51] Int. Cl.[5] ..... A47K 3/02

[52] U.S. Cl. ..... 4/583; 4/DIG. 18

[58] Field of Search ..... 4/581, 582, 583, DIG. 18

[56] References Cited

U.S. PATENT DOCUMENTS

| | | | |
|---|---|---|---|
| 2,080,601 | 5/1937 | Cappuccio | 4/580 |
| 2,853,714 | 9/1958 | Darmstadt | 4/580 |
| 3,045,254 | 7/1962 | Cook et al. | 4/580 |
| 3,133,292 | 5/1964 | Spier | 4/580 |
| 3,460,167 | 8/1969 | Benjamin | 4/580 |
| 3,836,420 | 9/1974 | Freese | 4/582 X |
| 4,511,621 | 4/1985 | Thomas et al. | 4/582 X |

FOREIGN PATENT DOCUMENTS

| | | | |
|---|---|---|---|
| 3323073 | 1/1985 | Fed. Rep. of Germany | 4/582 |
| 12723 | 3/1929 | United Kingdom | 4/582 |

*Primary Examiner*—Daniel M. Yasich

*Attorney, Agent, or Firm*—Frank D. Gilliam

[57] ABSTRACT

An improved bathtub or shower enclosure designed to prevent injury to the user in the event of a slip and fall accident or the like. The tub or shower stall floor and walls and water control fixtures are constructed or lined with a thin exterior layer of a resilient material to absorb the shock of a person falling and thereby preventing injury to that person. The floor of the tub or stall includes non-slip material on the surface of or formed into the resilient material. For an initial installation, a shell of the resilient material with non-slip material on the exposed floor or bottom surface is supported by a frame work constructed of rigid material such as wood or the like. For the after market, a liner of resilient material with non-slip material thereon is fitted over the existing bathtub or shower stall surfaces and over the water control fixtures and is fixedly attached thereto.

12 Claims, 1 Drawing Sheet

SAFETY BATHING SHOWER/TUB APPARATUS

This application is a continuation of application Ser. No. 07/617,145, filed Nov. 23, 1990, now abandoned.

BACKGROUND OF THE INVENTION

The invention is directed to bathtubs, shower enclosures, water control fixtures and the like and more particularly to resilient surfaces for bathtubs, shower stalls and the like and the placement of or integral formation of non-slip material on the resilient on floor or bottom bathtub and shower stalls to prevent injury to the user from slipping and falling and in the event of a slip and fall accident protecting that person from serious impact injury.

Bathtubs, shower stalls, faucets and water delivery fixtures are well known in the art and generally bathtubs are constructed of cast iron covered with porcelain, panted or gel coated fiberglass, painted metal, or the like, shower stalls are generally similarly constructed and fixtures and water delivery fixtures are protruding metal devices. The prior art bathtubs and shower stalls are generally constructed as a completed unit and installed in a desired location in a dwelling or the like and attached to the necessary plumbing for a source of hot and cold water and a suitable drain.

It is well known that numerous slip and fall accidents occur in these devices as they now exist. Although some of the falls are non-injurious, most result in some injury to at least result in soft tissue injuries that require no medical attention, while others result in more serious injuries and sometimes even in death of the injured person.

There have been numerous attempts to prevent these slip and fall injuries that frequently occur to bathers. Prior art attempts to solve this problem can be found in the following U.S. Pat. Nos. 2,080,601; 3,045,254; 3,133,292; 3,429,085; and British Patent number 809,206. The problems in the teachings of these patents is that both the tubs, shower stalls and fixtures are covered with a protective resilient cover or coatings none of these prior art devices consider that the outer surfaces of the resilient material suggested is in itself very slick when becoming wet and itself lends to causing a person using the tub or shower to be more susceptible to a slip and fall accident. Granted the resilient material would probably prevent severe injury to a person falling but the trauma of the fall and any injury even so slight can cause serious mental injury the that person especially if that person is frail and/or elderly.

Some bathtubs and stalls have non-slip material attached to the bottom or on floors thereof, numerous adhesive strips with exposed rough surfaces in the form of designs, etc. are available for adhesive attachment to the bottom of tubs and floors of shower stalls. Admittedly, these devices aid in preventing a person from slipping when using a bathtub or shower. Also it is well known that railings are provide for elderly people to assist there entry into and exit from a bathtub or shower stall. Like the prior mentioned anti-slip devices, these railings prevent many slip and fall accidents.

Even with the above devices in place an occasional slip and fall accident results causing severe injury while entering, transgressing or exiting a bath tub or shower stall.

There is no teachings in these prior art references to in addition to the resilient material provided some form of a non-slip surface either in the form of add on non-slip strips or ridges or the like formed in the exposed bottom or floor of the resilient material.

Until the emergence of the present invention there has been no means to prevent injury to that occasional slip and fall injury occurring in a bathtub or shower stall.

SUMMARY OF THE INVENTION

This invention is directed to a resilient surface for a bath tub and/or a shower stall to prevent a person slipping or in the event that a slip accident occurs to a person using either device a minimal amount of injury occurs to that person.

Bath tubs and shower stalls are generally constructed of cast iron covered with porcelain, fiberglass or other hard surface material and as noted in the prior art patents may have a resilient smooth outer surface addition which when stopping a fall of a person generally causes some physical or mental injury to that person. In order to prevent or further reduce injury to a falling person, a resilient surface is provided on the user adjacent side or sides of the tub or stall and non-slip material is either attached on the outer surface thereof or is formed in the resilient material. In initial construction of a tub or stall using the invention, a frame work of wood, plastic, metal or the like is formed in the general shape of the final tub or stall and a pre-formed plastic foam or other suitable resilient material in the desired shape of the tube or stall is attached to the frame work and a suitable seal is made between the drain and the liner.

For pre-existing tubs and stalls a retro-fit liner is formed which confirms to the existing surface contour of the tub or stall and is fixedly attached thereto in a sealed relationship so that the operation of the drain, etc is normal.

The surface or liner can be formed of a closed cell foam with a hardened yet resilient exposed surface or with a thin layer or film of a non-porous material in the form of a laminate. The bottom or floor exposed surface is roughened during formation or has a roughened strips attached thereto. Various types of foam can be used as for example, polyurethane, polyimide, polyamide, etc. A layer of film of further compressed foam identical to the foam filler, Kevlar, etc could be used for the outer exposed surface.

An object of this invention is to provide the exposed surface of a bath tub or shower stall with a resilient covering having the floor or bottom surface thereof provide with non-slip material that would aid in preventing any fall and would minimize injury to a bather therein in the event of a slip and fall.

Another object of the invention is to provide a conforming resilient liner with a non-slip floor or bottom surface for an existing bath tub or shower stall to prevent a fall or to prevent serious injury to a bather therein in the event of a slip and fall.

Yet another object of this invention is to provide an economically inexpensive means and method for preventing a fall or reducing an injury to a bather falling in a bathtub or shower stall.

These and other objects and advantages of the present invention will become apparent to those skilled in the art after considering the following detailed specification in which the preferred embodiment are described in conjunction with the accompanying drawing Figures.

BRIEF DESCRIPTION OF THE DRAWING FIGURES

DETAILED DESCRIPTION OF THE PREFERRED EMBODIMENTS OF THE INVENTION

Figure 1:
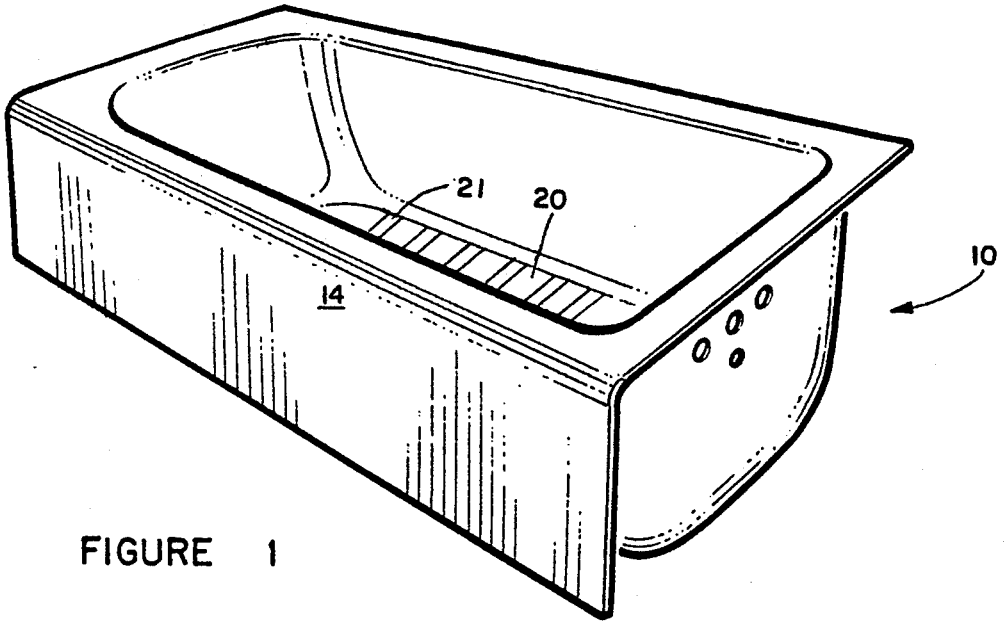
FIG. 1 is a perspective showing of a conventional bath tub design with the exposed resilient covering of the present invention.
Figure 2:
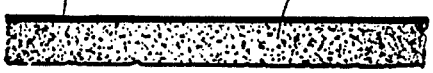
FIG. 2 is a sectional cutaway showing of typical resilient material of the covering or construction of the bathtub or shower stall of the present invention.

Referring now specifically to the drawing FIGS. 1 and 2, FIG. 1 depicts a conventional rigid bath tube 10, it should be understood that other bath tub configurations and designs exist and all configurations will benefit from equally as well with the present invention. The user exposed surfaces of the bathtub are formed of a resilient foam material or any other suitable resilient material. 12. The foam can be closed cell having tightly compressed material voids, partially closed cell or open cell foam, having material voids of a size intermediate open and closed cell material voids, open cell being substantially 50% void of material. The degree of openness of the cells depends on the resiliency of the material from which the foam is constructed. Various types of foam can be used as for example, polyurethane, polyimide, polyamide, etc. The foam material chosen and the degree of cell openings or material voids must be sufficiently resilient when in place to substantially prevent injury to the user of the bathtub or shower stall in the event of a fall therein by absorbing the shock thereof.

An outer surface material 14 is attached to the distal surface of the material 12, as more clearly, shown in drawing FIG. 2 is required to be resilient, resistive to wear and tear occurring in everyday use and water proof to prevent water from the bath or shower from penetrating therethrough to the underlying foam possibly causing destruction thereto. The outer surface 14 may be a cover or outer skin formed by the foam material further compressed to form a rigid skin to the exposed surface of the foam or can be a thin film or sheet material laminated to the outer surface of the foam. A surface layer of film of Kevlar, latex, etc could be used for the outer exposed surface. The material 14 located at the bottom surface 20' includes a roughened area 23 formed in the surface of the material 14 or comprises strips 21 as shown in drawing FIG. 1 molded into or attached to the surface 14 to prevent the somewhat slick wetted exposed surface 14 from causing the user to slip and fall while bathing. The roughened areas may include sand or the like embedded therein.

If a thin film or layer is laminated to the foam surface, a good bond is required to prevent moisture for penetrating between the outer film or layer and the foam. A good adhesive bonding medium can be used for this purpose chosen for its known adhesive bonding between the material of the foam and the material of the film or layer.

Figure 3:
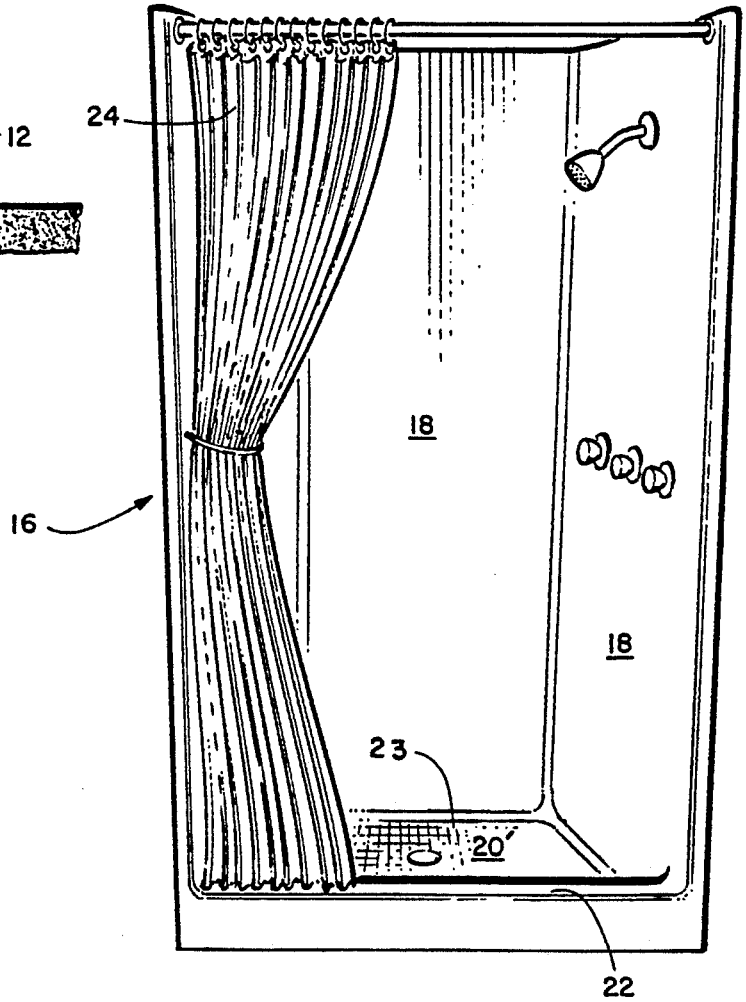
FIG. 3 is a prospective showing of a shower stall with the resilient exposed surface of the present invention.

Referring now to drawing FIG. 3, a conventional shower stall 16 is shown. It should be understood that a configured shower stall may be used with the present invention. All of the rigid upstanding walls 18 and the floor surface 20 including the berm or surface 22 at the bottom of the non-rigid wall 24 of the shower stall are constructed of or covered by the material as shown in drawing FIG. 2 and described above under discussion of both drawing FIGS. 1 and 2. Like the bathtub, the shower stall can be constructed in a similar manner or the invention can be provided as a liner in the same manner as the bath tub liner.

While there have been shown and described the preferred embodiment of the safety bathtub and shower stall in accordance with the invention, it will be appreciated that many changes and modifications may be made therein without, however, departing from the essential spirit thereof.

What is claimed is:

1. A safety bathing device suitable for use for a bathtub or shower stall for preventing slip and fall and injuries related thereto to the users thereof comprising:

said safety bathing device being formed from a layer of resilient shock absorbing foam material consisting of material selected from the following group of materials, polyurethane, polyimide and polyamide;

said safety bathing device having an outer surface, said outer surface being resilient and resistive to wear and tear water proof non-slip surface whereby a user is less apt to slip and fall and when a slip or fall occurs that user is less apt to be injured; and said safety bathing device forms a liner for covering substantially the entire outer surface of said bathtub or shower stall.

2. The invention as defined in claim 1 wherein said layer of resilient shock absorbing material is formed of a cellular foam.

3. The invention as defined in claim 2 wherein said cellular foam material is an open cell foam.

4. The invention as defined in claim 2 wherein said foam cellular material is a closed cell foam.

5. The invention as defined in claim 2 wherein said cellular foam material is a partially closed cell foam.

6. The invention as defined in claim 1 wherein said safety bathing device is a liner for an existing bathtub or shower stall.

7. The invention as defined in claim 1 wherein said outer surface is constructed from shock absorbing material.

8. The invention as defined in claim 1 wherein said outer surface of the shock absorbing material is attached to one surface of the resilient shock absorbing foam material.

9. The invention as defined in claim 1 wherein said non-slip material is formed in said bottom surface.

10. The invention as defined in claim 1 wherein said non-slip material is attached to said bottom surface.

11. The invention as defined in claim 10 wherein said non-slip material is a substance foreign to said bottom surface.

12. The invention as defined in claim 11 wherein said foreign substance is sand.

* * * * *